US012234001B2

(12) United States Patent
Kawai

(10) Patent No.: US 12,234,001 B2
(45) Date of Patent: Feb. 25, 2025

(54) OUTBOARD MOTOR

(71) Applicant: HONDA MOTOR CO., LTD., Tokyo (JP)

(72) Inventor: Norikazu Kawai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 490 days.

(21) Appl. No.: 17/676,870

(22) Filed: Feb. 22, 2022

(65) Prior Publication Data

US 2022/0281579 A1 Sep. 8, 2022

(30) Foreign Application Priority Data

Mar. 8, 2021 (JP) ..... 2021-036426

(51) Int. Cl.
*B63H 23/06* (2006.01)
*B63H 20/32* (2006.01)
*B63H 23/34* (2006.01)

(52) U.S. Cl.
CPC ..... *B63H 23/06* (2013.01); *B63H 20/32* (2013.01); *B63H 23/34* (2013.01); *B63H 2020/323* (2013.01)

(58) Field of Classification Search
CPC ..... B63H 23/00; B63H 23/06; B63H 23/34; B63H 20/00; B63H 20/32; B63H 2020/323
USPC ..... 440/6
See application file for complete search history.

(56) References Cited

U.S. PATENT DOCUMENTS

| | | | | |
|---|---|---|---|---|
| 4,263,994 | A | 4/1981 | Hayes | |
| 7,267,587 | B2 * | 9/2007 | Oguma | B63H 20/12 440/58 |
| 7,517,262 | B2 * | 4/2009 | Mizutani | B63H 20/12 440/58 |
| 10,800,502 | B1 * | 10/2020 | Alby | B63H 20/12 |

FOREIGN PATENT DOCUMENTS

| | | |
|---|---|---|
| JP | 06-221383 | 8/1994 |
| JP | 2005-280572 | 10/2005 |
| JP | 2007-186155 | 7/2007 |
| JP | 2010-105456 | 5/2010 |
| JP | 2015-071315 | 4/2015 |

OTHER PUBLICATIONS

Japanese Office Action for Japanese Patent Application No. 2021-036426 mailed Jan. 10, 2023.

* cited by examiner

*Primary Examiner* — Lars A Olson
(74) *Attorney, Agent, or Firm* — Amin, Turocy & Watson, LLP

(57) ABSTRACT

An outboard motor 10 includes a drive shaft 33, a propeller shaft 35, a worm wheel 66, and a worm 67. The drive shaft is connected to a drive motor 37 via a reduction unit 38. The propeller shaft is connected via a bevel gear unit to intersect the drive shaft. The worm wheel is disposed coaxially with the drive shaft and rotates to turn the propeller shaft around the drive shaft. The worm engages with the worm wheel and is connected to a steering motor. The worm has a torque receiving portion.

6 Claims, 6 Drawing Sheets

OUTBOARD MOTOR

CROSS-REFERENCE TO RELATED APPLICATION

Priority is claimed on Japanese Patent Application No. 2021-036426, filed Mar. 8, 2021, the content of which is incorporated herein by reference.

BACKGROUND OF THE INVENTION

Field of the Invention

The present invention relates to an outboard motor.

Description of Related Art

In general, outboard motors transmit, in a standard posture of a usage state, a rotational output of a power engine or electric motor to a drive shaft disposed in a vertical direction and convert rotation of the drive shaft into rotation around a horizontal shaft through a bevel gear to transmit it to a propeller shaft. By rotating the propeller shaft, a propeller attached to the propeller shaft is rotated around the horizontal shaft to propel a hull.

Here, among outboard motors, for example, there is an outboard motor including a steering mechanism that is electrically steered. In the steering mechanism, for example, a steering motor is connected to a steering shaft via a steering force transmission device. The steering force transmission device is provided with a lock clutch. According to this steering mechanism, by transmitting rotation of the steering motor to the steering shaft via the steering force transmission device, the steering shaft rotates to steer an outboard motor body in a left to right direction.

On the other hand, for example, even in a case in which a reaction force received from the water is exerted in the left to right direction during navigation, due to the lock clutch, it is not necessary to constantly drive the steering motor in order to maintain a steering direction.

The steering mechanism is configured, for example, to support the lock clutch with a casing and restrict rotation of the casing with a detent mechanism. The lock clutch can be invalidated by releasing rotation restriction of the casing by this detent mechanism. Accordingly, a user can manually rotate (steer) a steering portion in the left to right direction by pressing the steering portion (see, for example, Patent Document 1 (Japanese Patent Application, First Publication No. 2015-71315)).

SUMMARY OF THE INVENTION

However, for example, the outboard motor of Patent Document 1 needs to include a lock clutch in order to maintain a steering direction even in a case in which a reaction force received from the water is exerted to a steering portion in a left to right direction. For this reason, the number of parts increases, and from this perspective, it can be expected there is room for improvement.

Further, in a case in which a steering motor malfunctions, a direction of a propeller will be fixed to that at the time of malfunction. For this reason, for example, in a case in which a drive system for propelling is normally driven on the water, when the steering motor malfunctions, a hull will be in a state of not being propelled.

Thus, it is necessary to allow a steering mechanism to be manually operated when the steering motor malfunctions, thereby allowing a call at a port. When the steering mechanism is manually operated, first, an angle of a propeller is steered in the left to right direction, and then a hull is propelled toward a destination. Next, by returning the angle of the propeller to make the hull go straight, it is possible to go straight toward the destination. However, in the outboard motor of Patent Document 1, the steering mechanism cannot be manually operated from the hull side on the water.

An object of the present invention is to provide an outboard motor in which a steering direction can be maintained against a reaction force received from the water without increasing the number of parts, and which can be manually operated on the water.

In order to solve the above problems, an outboard motor of the present invention has adopted the following configurations.

(1) An outboard motor according to one aspect of the present invention is an outboard motor that propels a hull by rotating a propeller with a drive source, including: a drive shaft connected to the drive source; an output shaft that is connected to intersect the drive shaft and with which a propeller is provided; a worm wheel that is disposed coaxially with the drive shaft and rotates to turn the output shaft around the drive shaft; and a worm that engages with the worm wheel and is connected to a rotating electric machine, in which the worm includes a torque receiving portion that receives a torque for rotating the worm at the other end portion on a side opposite to one end portion connected to the rotating electric machine.

According to the aspect (1), the worm wheel is disposed coaxially with the drive shaft, and the output shaft is turned around the drive shaft by rotating the worm wheel. The worm is caused to engage with the worm wheel, and the worm is connected to the rotating electric machine.

Accordingly, by rotating the worm with the rotating electric machine, the worm wheel can be rotated with the worm. Thus, the outboard motor can be steered by turning the output shaft around the drive shaft.

The worm is caused to engage with the worm wheel that turns the output shaft. Accordingly, during navigation, for example, even in a case in which a reaction force received from the water is exerted in a left to right direction, self-locking due to the worm wheel and the worm (that is, a worm gear) can be secured. Thus, a steering direction can be maintained against the reaction force received from the water without increasing the number of parts with a simple configuration of the worm wheel and the worm. Accordingly, it is not necessary to constantly energize the rotating electric machine to constantly drive the rotating electric machine in order to maintain the steering direction of the outboard motor, and power consumption can be reduced. Further, by reducing a load on the rotating electric machine, durability of the rotating electric machine can be improved.

Furthermore, the torque receiving portion is formed at the other end portion of the worm on the side opposite to the rotating electric machine. Accordingly, for example, by manually rotating the torque receiving portion, the output shaft can be rotated by the worm wheel. Thus, the outboard motor can be manually steered without increasing the number of parts with a simple configuration of forming the torque receiving portion in the worm.

Incidentally, for example, when the worm is manually operated to call at a port in a case in which the rotating electric machine malfunctions on the water, first, the torque receiving portion is manually rotated to turn (steer) the output shaft (that is, the propeller) in the left to right direction, and then the hull is propelled toward the direction of a destination. Next, the torque receiving portion is manually rotated again to return the propeller to a go-straight state of the hull, thereby causing it to go straight toward the destination.

Here, self-locking of the worm wheel and worm are secured by a worm gear mechanism. Accordingly, even when the propeller receives a force such as resistance from the water, the propeller can be held in a go-straight position of the hull. Thus, the hull can be kept in the go-straight state even when hands are released from the torque receiving portion. That is, on the water, the steering mechanism of the worm wheel and the worm can be manually operated.

(2) The outboard motor according to the above aspect (1) may include a case that covers the worm and includes an opening portion formed at a portion corresponding to the torque receiving portion, and a cap that is detachably attached to the opening portion and covers the opening portion.

According to the aspect (2), the worm is covered with the case, and the opening portion is formed at the portion of the case corresponding to the torque receiving portion. Further, the cap is detachably attached to the opening portion, and the opening portion is covered with the cap. Thus, the worm can be protected from the water with the cap. Furthermore, the torque receiving portion can be easily rotated manually simply by removing the cap from the opening portion.

(3) The outboard motor according to the above aspect (1) may include a case that covers the worm and includes an opening portion formed at a portion corresponding to the torque receiving portion, and the torque receiving portion may be a member having corrosion resistance.

According to the aspect (3), for example, the torque receiving portion is made of a corrosion-resistant material, or the torque receiving portion is subjected to a corrosion-resistant surface treatment, thereby forming the torque receiving portion as a member having corrosion resistance. Accordingly, for example, it is possible to eliminate the need for a cap that protects the torque receiving portion from the water. Thus, for example, the torque receiving portion can be manually rotated more easily.

(4) In the outboard motor according to any one of the above (1) to (3), the torque receiving portion may be disposed at a position at which it is rotatable from the hull.

According to the aspect (4), the torque receiving portion is disposed at a position at which it is rotatable from the hull. Thus, a user can easily rotate the torque receiving portion from the hull, and the outboard motor can be easily steered manually.

(5) The outboard motor according to the aspect (2) or (3) may include a cover that is detachably attached to the case and covers the rotating electric machine provided in the case.

According to the aspect (5), the rotating electric machine is provided outside the case, and the rotating electric machine is covered with the cover. Thus, the rotating electric machine can be protected from the water by the cover. Simply by removing the cover from the case, for example, the rotating electric machine can be maintained and inspected.

According to the present invention, the steering direction can be maintained against the reaction force received from the water without increasing the number of parts.

DETAILED DESCRIPTION OF THE INVENTION

An embodiment of the present invention will be described below with reference to the drawings. Also, "Fr" indicates forward with respect to a traveling direction, and "Rr" indicates rearward with respect to the traveling direction. Hereinafter, "forward with respect to the traveling direction" may be simply referred to as "forward," and "rearward with respect to the traveling direction" may be simply referred to as "rearward." A "front to rear direction with respect to the traveling direction" may be simply referred to as a "front to rear direction," and a direction orthogonal to the "front to rear direction" may be simply referred to as a "left to right direction."

Hereinafter, an outboard motor 10 of the embodiment will be described based on a standard posture in which a drive shaft 33 is disposed substantially vertically, and a propeller shaft 35 is disposed in the front to rear direction.

Figure 1:
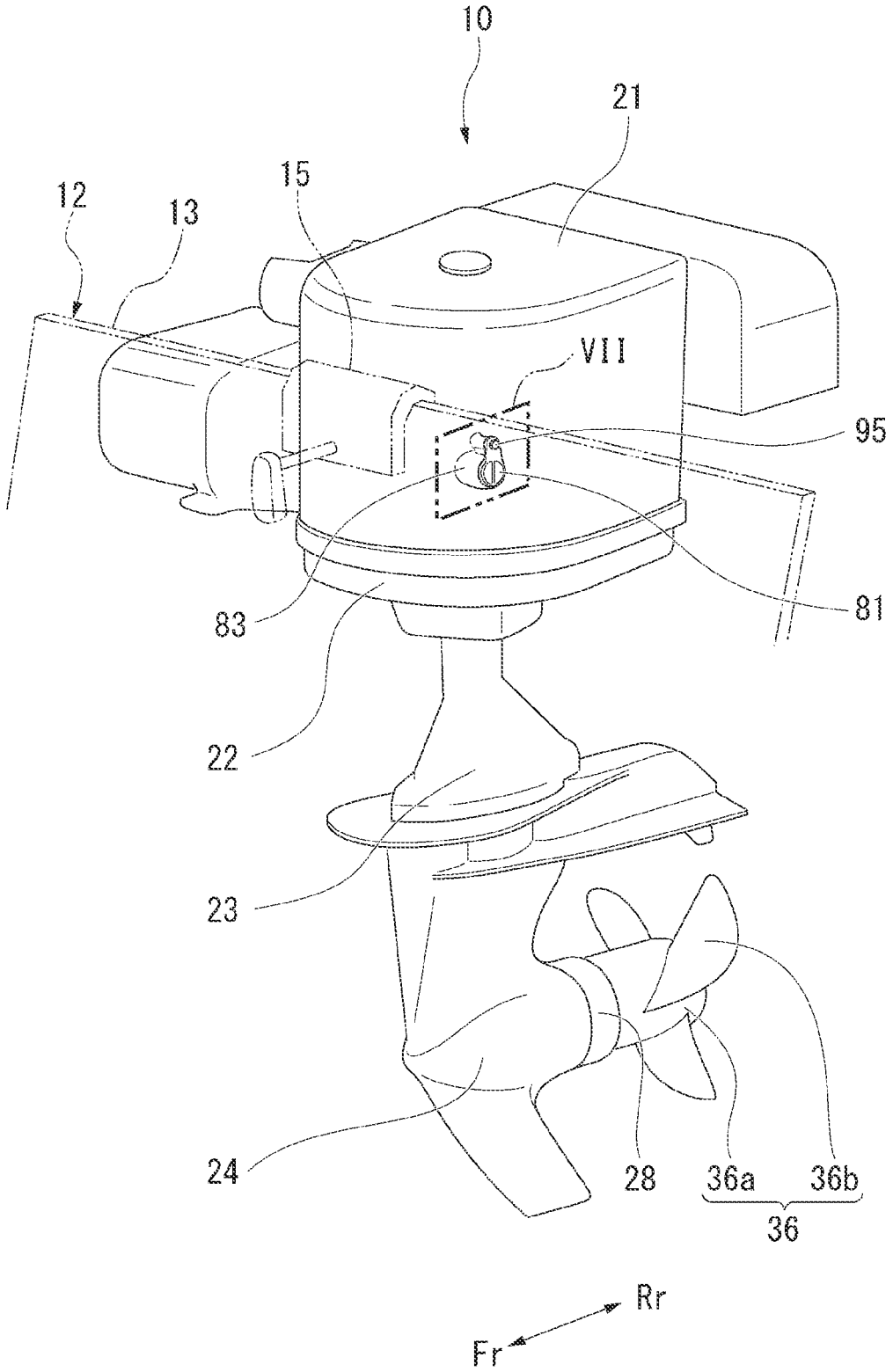
FIG. 1 is a perspective view of an outboard motor of an embodiment according to the present invention from a left front side in a navigating direction of a hull.
Figure 2:
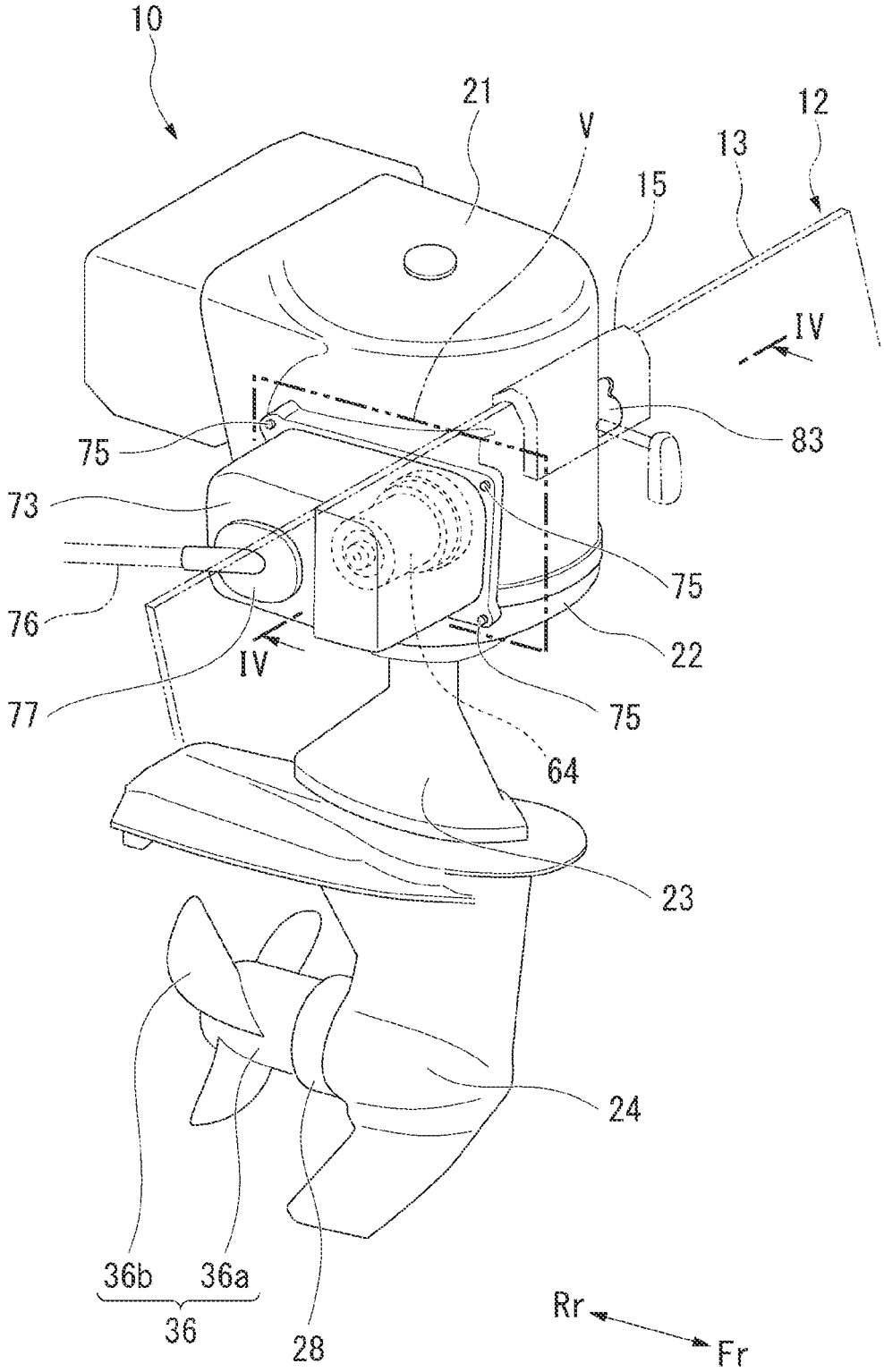
FIG. 2 is a perspective view of an outboard motor of an embodiment from a left front side in the navigating direction of the hull.
Figure 3:
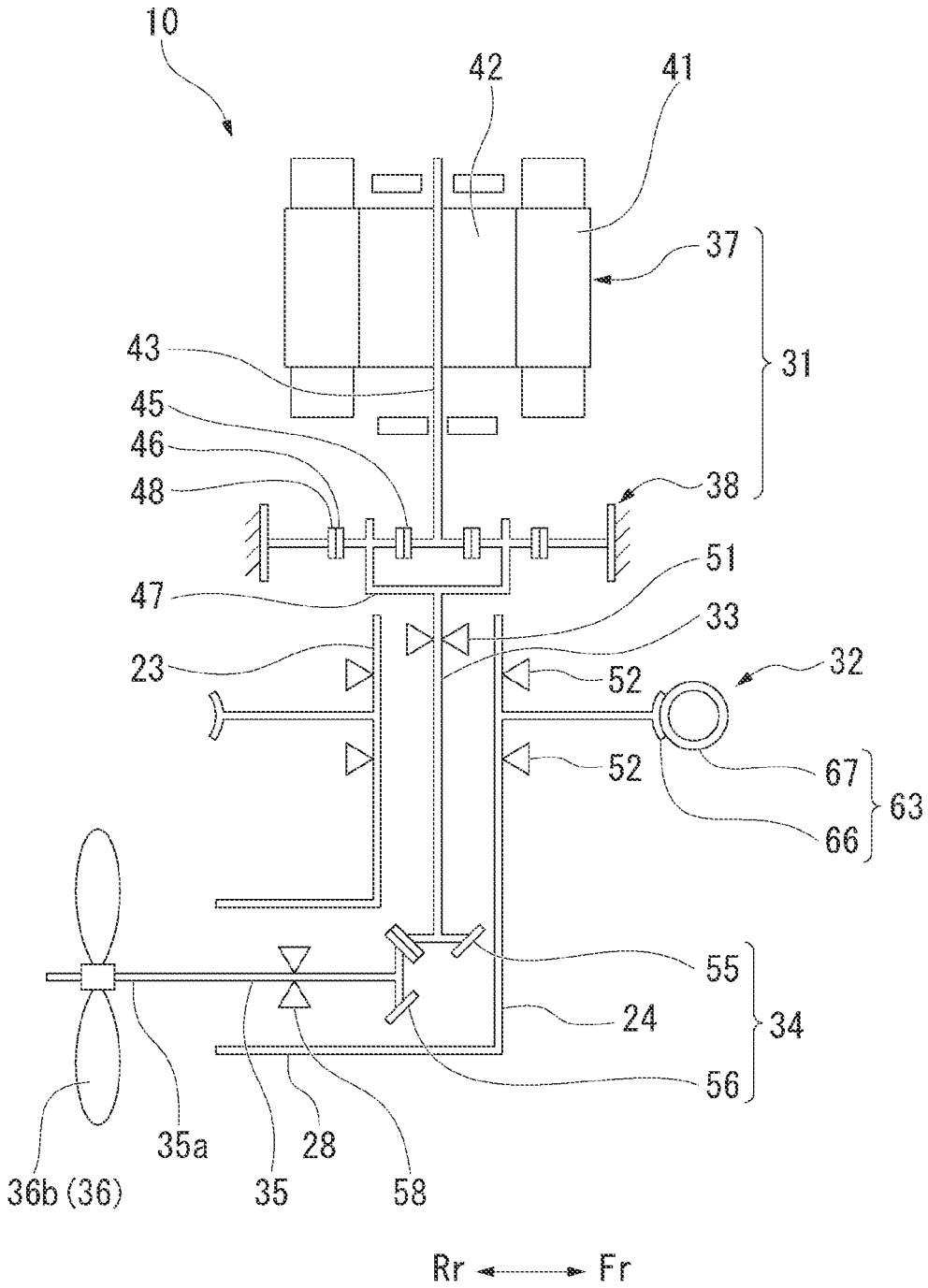
FIG. 3 is a conceptual diagram conceptually illustrating a drive system of the outboard motor of the embodiment.

As shown in FIGS. 1 to 3, the outboard motor 10 is a propelling device that is provided in a stern 13 of a hull 12 via a stern bracket 15 to propel the hull 12. The outboard motor 10 includes a case 21, an oil pan 22, a drive shaft case 23, a gear case 24, a power unit 31, a steering mechanism 32, the drive shaft 33, a bevel gear unit 34, the propeller shaft (an output shaft) 35, and a propeller 36.

The case 21 is fixed to an upper portion of the oil pan 22. The power unit 31 and the steering mechanism 32 (particularly, a worm gear 63) are housed in the case 21. The case 21 is mounted on the stern 13 of the hull 12 via the stern bracket 15. More specifically, the case 21 is attached to the stern bracket 15 to be swingably supported in a vertical direction via a tilt axis (not shown) of the stern bracket 15.

The oil pan 22 stores, for example, oil that cools and lubricates an electric motor 37 and a reduction unit 38 of the power unit 31, which will be described later, the worm gear 63 of the steering mechanism 32, and the like.

The power unit 31 includes the electric motor 37 and the reduction unit 38. The electric motor 37 will be described below as a "drive motor 37." The drive motor 37 is an electric motor that serves as a power source (a drive source) for rotating the propeller 36, which will be described later.

In the drive motor 37, for example, a rotation shaft 43 is disposed to face in the vertical direction, and a rotor 42 is rotatably supported inside a stator 41. The rotation shaft 43 is supported by the rotor 42, and the reduction unit 38 is connected to the rotation shaft 43.

In the reduction unit 38, a sun gear 45 is fixed to a rotation shaft, and a plurality of planetary gears 46 engage with the sun gear 45. The plurality of planetary gears 46 are rotatably supported by a carrier 47 and engage with a ring gear (an internal gear) 48. The ring gear 48 is fixed to the case 21, for example. The drive shaft 33 is coaxially fixed to the carrier 47. The reduction unit 38 decelerates a rotation speed of the drive motor 37 at a reduction ratio i and transmits it to the drive shaft 33.

The drive shaft 33 extends coaxially downward from the carrier 47 of the reduction unit 38 and is connected to the bevel gear unit 34 in a state in which it is inserted inside the drive shaft case 23. That is, the drive shaft 33 is connected to the drive motor 37 via the reduction unit 38 and is disposed substantially vertically.

The drive shaft 33 is housed in the drive shaft case 23 and is rotatably supported by the drive shaft case 23 via a bearing 51. The drive shaft case 23 is rotatably supported by, for example, the case 21 via bearings 52 and 52.

The bevel gear unit 34 includes a first bevel gear 55 on an input side and a second bevel gear 56 on an output side. The first bevel gear 55 is coaxially fixed to the drive shaft 33 and engages with the second bevel gear 56. The second bevel gear 56 is coaxially fixed to the propeller shaft 35. The bevel gear unit 34 is housed in the gear case 24. The gear case 24 is integrally fixed to the drive shaft case 23.

The propeller shaft 35 extends in a direction intersecting the drive shaft 33 and rearward from the second bevel gear 56. That is, the propeller shaft 35 is connected to intersect the drive shaft 33 via the bevel gear unit 34. A base end portion of the propeller shaft 35 fixed to the second bevel gear 56 is housed in the gear case 24.

The propeller shaft 35 protrudes rearward from the second bevel gear 56 via a propeller holder 28. The propeller holder 28 is fixed to the gear case 24. For example, the base end portion of the propeller shaft 35 is rotatably supported by the propeller holder 28 via a bearing 58. The propeller 36 for propelling is provided at a portion 35*a* of the propeller shaft 35 that protrudes rearward from the propeller holder 28. The propeller 36 is provided with blades 36*b* on a propeller cylinder portion 36*a* that rotates together with the propeller shaft 35.

Here, the drive shaft case 23, the gear case 24, and the propeller holder 28 are integrally fixed. The propeller cylinder portion 36*a* extends horizontally rearward from the propeller holder 28. Accordingly, the drive shaft case 23, the gear case 24, the propeller holder 28, and the propeller cylinder portion 36*a* are formed in an L shape when seen from a side view.

By driving the drive motor 37, rotation of the rotation shaft 43 is transmitted to the propeller 36 via the reduction unit 38, the drive shaft 33, the bevel gear unit 34, and the propeller shaft 35. The hull 12 is propelled by rotation of the propeller 36.

Figure 4:
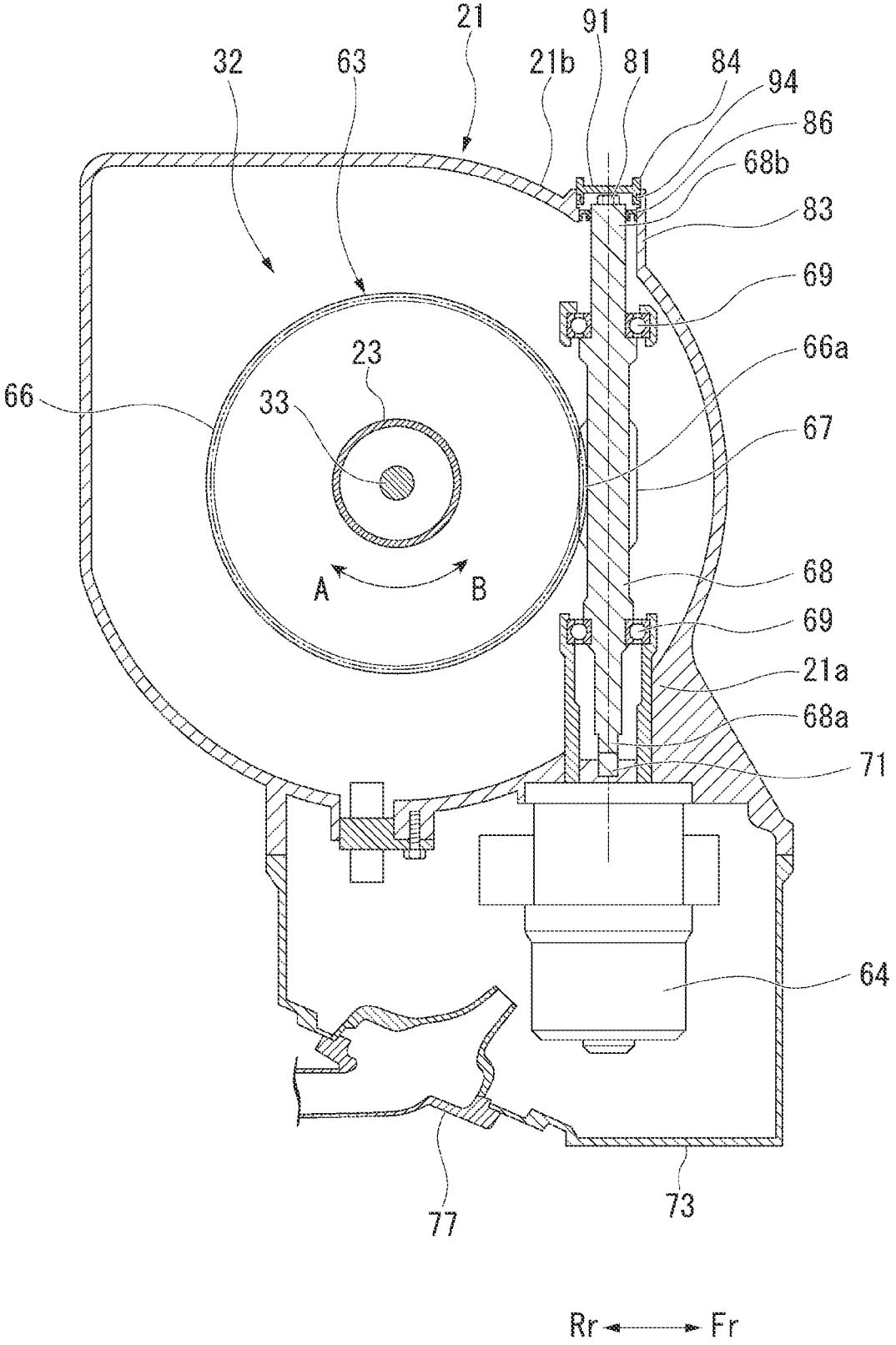
FIG. 4 is a cross-sectional view along line IV-IV in FIG. 2.

As shown in FIGS. 3 and 4, the steering mechanism 32 includes the worm gear 63 and a steering motor (a rotating electric machine) 64. The worm gear 63 is disposed, for example, in a state in which it is covered with the case 21 and includes a worm wheel 66 and a worm 67. For example, the worm wheel 66 is fixed to an outer circumferential wall of the drive shaft case 23 in a state in which it is disposed coaxially with the drive shaft 33. The worm 67 engages with a front end portion 66*a* of the worm wheel 66.

The worm 67 extends in a direction intersecting the front to rear direction (that is, in the left to right direction) and in a horizontal direction. The worm 67 is rotatably supported by the case 21 via, for example, a pair of bearings 69. In the worm 67, one end portion 68*a* of a worm shaft 68 is connected to a rotation shaft 71 of the steering motor 64.

Accordingly, by driving the steering motor 64, the worm shaft 68 (that is, the worm 67) can be rotated by the rotation shaft 71. By rotating the worm 67, the worm wheel 66 can be rotated by the worm 67. By rotating the worm wheel 66, the drive shaft case 23 can be rotated in a direction of arrow A or B about the drive shaft 33.

Here, as described above, the drive shaft case 23, the gear case 24, the propeller holder 28, and the propeller cylinder portion 36*a* are formed in an L shape in a side view. The propeller shaft 35 is rotatably supported by the propeller holder 28 via the bearing 58. Accordingly, by rotating the drive shaft case 23 with the worm wheel 66, the propeller shaft 35 and the propeller 36 can be turned in the direction of arrow A or B with the drive shaft 33 as a central axis, and thus the outboard motor 10 can be steered.

Figure 5:
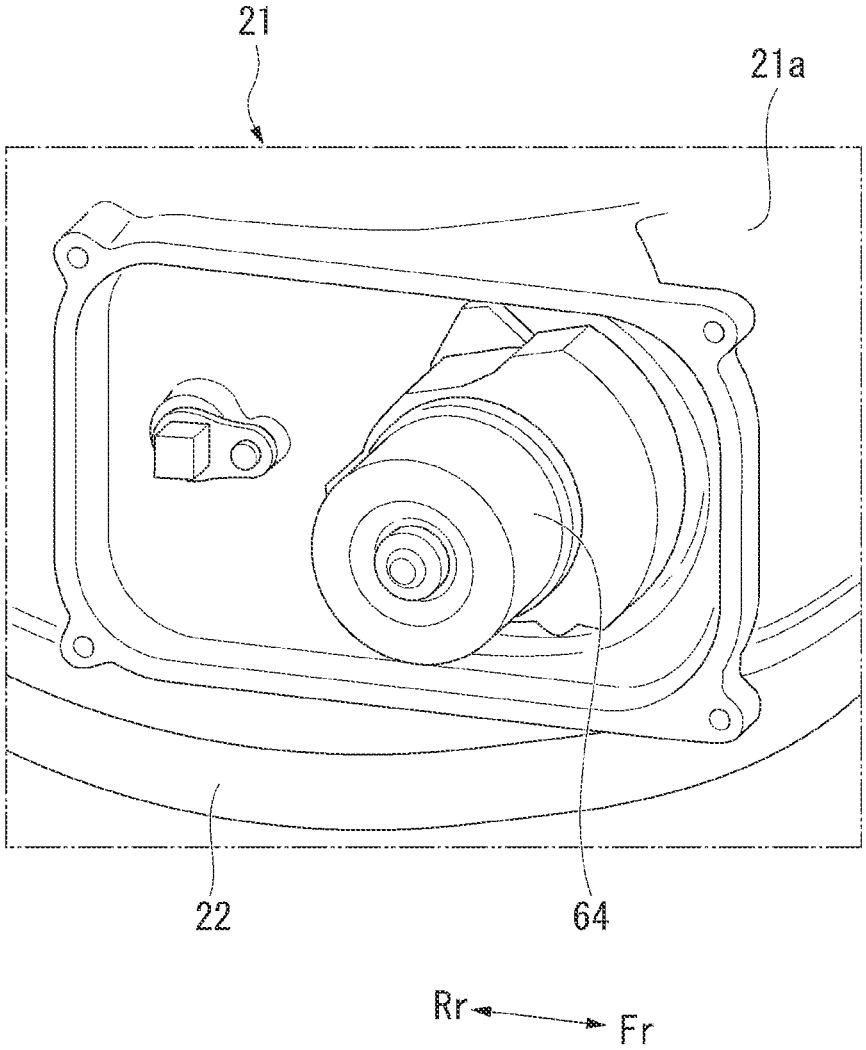
FIG. 5 is an enlarged perspective view showing a state in which a cover is removed from section V in FIG. 2.

As shown in FIGS. 2, 4, and 5, the steering motor 64 is an electric motor attached to an outer portion of the case 21. Specifically, the steering motor 64 is attached to a motor attachment portion 21*a*, which is located on one side wall in the left to right direction and on a front side closer to the hull 12 in an outer circumferential wall of the case 21. That is, the steering motor 64 is disposed near the hull 12 so that it is visible from the hull 12 and can be maintained and inspected from the hull 12. The steering motor 64 is covered with a cover 73 from the outside of the case 21.

The cover 73 is detachably attached to the motor attachment portion 21*a* of the case 21 from the outside with, for example, bolts 75. A wire harness 76 connected to the steering motor 64 is arranged inside the cover 73 via a grommet 77. Thus, the steering motor 64 can be protected from the water by the cover 73. For example, the steering motor 64 can be easily maintained and inspected simply by removing the cover 73 from the case 21.

Figure 6:
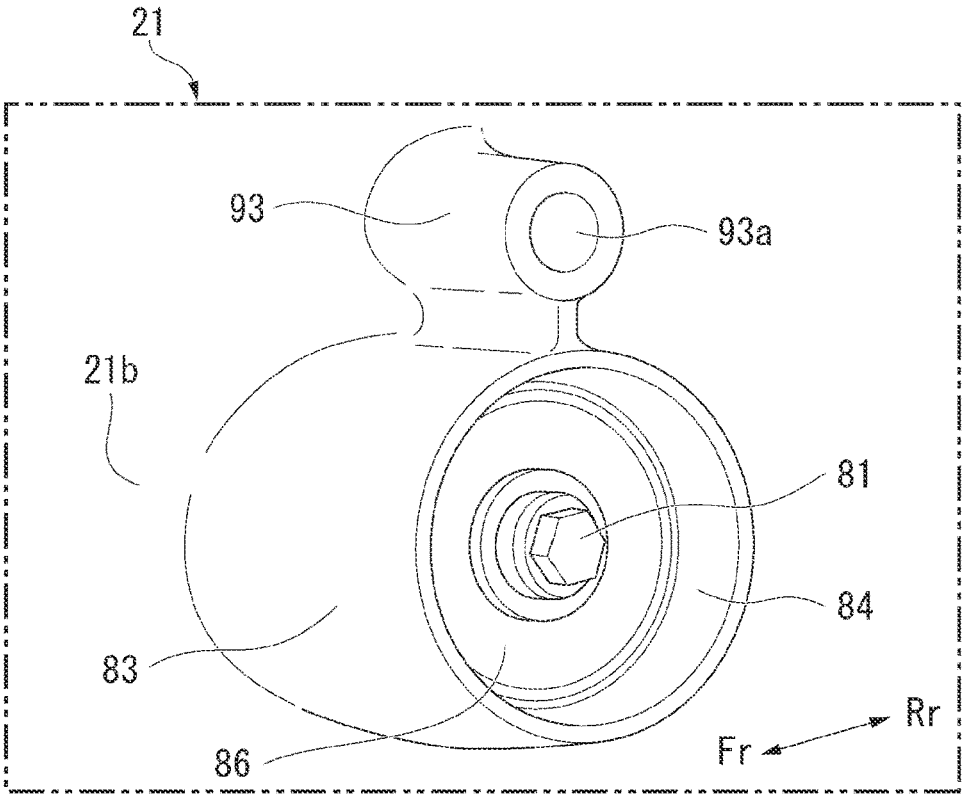
FIG. 6 is a perspective view showing a torque receiving portion and an opening portion of an embodiment.

As shown in FIGS. 3, 4, and 6, a torque receiving portion 81 is formed at the other end portion 68*b* on a side opposite to the one end portion 68*a* of the worm shaft 68. The torque receiving portion 81 is formed to have, for example, six surfaces in a hexagonal shape like a head of a bolt. In the embodiment, the hexagonal surfaces will be described as an example of the torque receiving portion 81, but the torque receiving portion 81 is not limited thereto. As another example, for example, the torque receiving portion 81 may be formed to have four surfaces in a quadrangular shape, or the torque receiving portion 81 may be formed in a spline shape or the like.

The torque receiving portion 81 is disposed at a position corresponding to an opening portion 84 (which will be described later) of the case 21. Thus, for example, by manually turning a tool such as a ratchet or torque wrench for tightening a bolt, the torque receiving portion 81 can receive a manual torque transmitted from the tool (hereinafter, may be referred to as a manual torque).

That is, for example, when the steering motor 64 malfunctions, the torque receiving portion 81 receives the manual torque transmitted from the tool, and the torque receiving portion 81 can be rotated by the manual torque. By rotating the torque receiving portion 81, the worm shaft 68 (that is, the worm 67) can be rotated. By rotating the worm 67, the worm 67 can rotate the worm wheel 66 in the direction of arrow A or B. By rotating the worm wheel 66, the drive shaft case 23 can be rotated about the drive shaft 33.

By rotating the drive shaft case 23, the propeller shaft 35 can be turned in the direction of arrow A or B with the drive shaft 33 as the central axis, and thus the outboard motor 10 can be steered. Thus, the outboard motor 10 can be manually steered without increasing the number of parts with a simple configuration of forming the torque receiving portion 81 on the worm 67.

Here, in the case 21, the opening portion 84 is formed at a portion corresponding to the torque receiving portion 81.

The opening portion 84 is formed by opening to a boss 83 that protrudes from an opening forming portion 21*b*, which is located on the other side wall on a side opposite to the steering motor 64 in the left to right direction and on a front side closer to the hull 12 in the outer circumferential wall of the case 21. That is, the opening portion 84 is disposed near the hull 12 to be visible from the hull 12 and within reach of the user from the hull 12.

The torque receiving portion 81 is disposed to be exposed from the opening portion 84 to the outside of the case 21. Accordingly, the torque receiving portion 81 is disposed near the hull 12 to be visible from the hull 12 and within reach of the user from the hull 12. An oil seal 86 is provided in the opening portion 84, and a space between the opening portion 84 and the torque receiving portion 81 is sealed by the oil seal 86.

Figure 7:
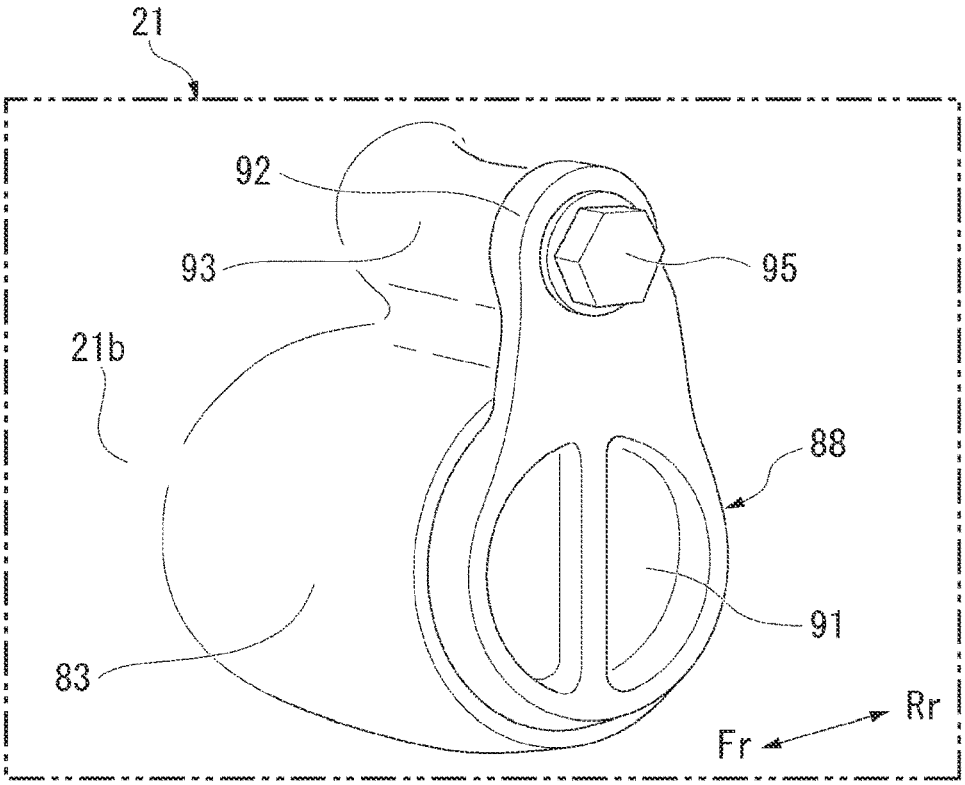
FIG. 7 is an enlarged perspective view showing section VII in FIG. 2.

As shown in FIGS. 1, 6, and 7, a cap 88 is detachably attached to the opening portion 84. Accordingly, the cap 88 is disposed near the hull 12 to be visible from the hull 12 and within reach of the user from the hull 12.

The cap 88 has a cap body 91 and an attachment piece 92. The attachment piece 92 is detachably attached to a boss 93 by screwing a bolt 95 to the boss 93 (specifically, a screw hole 93*a*) of the opening forming portion 21*b*.

In this state, the cap body 91 can cover the opening portion 84 from the outside of the case 21. Further, an O-ring 94 of the cap body 91 can seal a gap between the cap body 91 and the opening portion 84. Thus, the torque receiving portion 81 of the worm 67 (specifically, the worm shaft 68) can be protected from the water by the cap 88.

By removing the bolt 95 from the boss 93, the cap 88 can be removed from the opening portion 84. In this way, simply by removing the cap 88 from the opening portion 84, the torque receiving portion 81 can be easily rotated manually.

Here, the cap 88 is disposed at a position visible to the user from the hull 12 and at a position within reach of the user. Accordingly, the user can easily remove the cap 88 from the hull 12 by loosening the bolt 95.

With the cap 88 removed from the opening portion 84, the torque receiving portion 81 is exposed to the outside of the case 21 from the opening portion 84. Here, the torque receiving portion 81 is disposed at a position visible to the user from the hull 12 and at a position within reach of the user. Accordingly, a manual torque can be easily applied from the hull 12 to the torque receiving portion 81 by using a tool.

Also, the torque receiving portion 81 may be made of a corrosion-resistant material, or the torque receiving portion 81 may be subjected to a corrosion-resistant surface treatment. Accordingly, a member having corrosion resistance can be used for the torque receiving portion 81, and for example, the cap 88 that protects the torque receiving portion 81 from the water can be eliminated. Thus, for example, the torque receiving portion 81 can be manually rotated more easily.

As described above, according to the outboard motor 10 of the embodiment, as shown in FIGS. 3 and 4, a torque T of the drive motor 37 is transmitted to the reduction unit 38 by driving the drive motor 37. The rotation speed of the drive motor 37 is decelerated by a reduction ratio i of the reduction unit 38, and a torque T×i is transmitted to the drive shaft 33. The torque T×i of the drive shaft 33 is transmitted to the propeller shaft 35 via the bevel gear unit 34, and the propeller shaft 35 rotates. As the propeller shaft 35 rotates, the propeller 36 rotates to propel the hull 12.

Here, the torque T×i is transmitted from the reduction unit 38 to the drive shaft 33, and the torque T×i is also transmitted to the drive shaft case 23 as a reaction force. Thus, the worm wheel 66 of the worm gear 63 is provided on the drive shaft case 23, and the worm 67 is caused to engage with the worm wheel 66. Accordingly, the torque T×i transmitted as the reaction force to the drive shaft case 23 can be supported by the worm 67. That is, the reaction torque T×i transmitted to the drive shaft case 23 is supported by self-locking of the worm gear 63 configured of the worm wheel 66 and the worm 67, such that the drive shaft case 23 can be maintained in the steering direction.

Thus, the steering direction can be maintained with respect to the reaction torque T×i received from the drive motor 37 and the reduction unit 38 without increasing the number of parts with a simple configuration of the worm wheel 66 and the worm 67.

During navigation, for example, even in a case in which a reaction force received from the water is exerted to the propeller 36 in the left to right direction, self-locking due to the worm wheel 66 and the worm 67 (that is, the worm gear 63) can be secured. Thus, the steering direction can be maintained with respect to the reaction force received from the water without increasing the number of parts with a simple configuration of the worm wheel 66 and the worm 67.

In this way, the reaction torque T×i received from the reduction unit 38 (that is, the drive motor 37) and the reaction force received from the water can be supported by the self-locking of the worm gear 63. Thus, it is not necessary to constantly energize the steering motor 64 to constantly drive the steering motor 64 in order to maintain the steering direction of the outboard motor, and power consumption can be reduced. Further, by reducing a load on the steering motor 64, durability of the steering motor 64 can be improved.

As shown in FIGS. 1, 6 and 7, the cap 88 and the torque receiving portion 81 are disposed at the position visible to the user from the hull 12 and at the position within reach of the user. Accordingly, the user of the hull 12 can easily apply manual torque to the torque receiving portion 81 using a tool by removing the cap 88 from the opening portion 84. Thus, for example, if the steering motor 64 malfunctions, the user of the hull 12 can safely rotate the torque receiving portion 81, and the outboard motor 10 can be easily steered manually.

Incidentally, as shown in FIGS. 3 and 4, for example, on the water, when the worm 67 is manually operated to call at a port in a case in which the steering motor 64 malfunctions, first, the torque receiving portion 81 is manually rotated to turn (steer) the propeller shaft 35 (that is, the propeller 36) in the left to right direction, and then the hull 12 (see FIG. 1) is propelled toward a destination. Next, the torque receiving portion 81 is manually rotated again to return the propeller 36 to a go-straight state of the hull 12, thereby causing the hull 12 to go straight toward the destination.

Here, self-locking of the worm wheel 66 and worm 67 are secured by the worm gear mechanism. Accordingly, even when the propeller 36 receives a reaction force (a force such as resistance due to water) from the water, the propeller 36 can be held in a go-straight position of the hull 12 (see FIG. 1). Thus, the hull 12 can be kept in a go-straight state even when hands are released from the torque receiving portion 81. That is, the steering mechanism of the worm wheel 66 and the worm 67 can be manually operated on the water.

Also, the technical scope of the present invention is not limited to the above-described embodiment, and various changes can be made without departing from the spirit of the present invention.

In addition, it is appropriately possible to replace constituent elements in the above-described embodiment with well-known constituent elements without departing from the spirit of the present invention, and the above-mentioned modified examples may be appropriately combined.

EXPLANATION OF REFERENCES

10 Outboard motor
12 Hull
21 Case
23 Drive shaft case
25 Propeller shaft case
31 Power unit
32 Steering mechanism
33 Drive shaft
35 Propeller shaft (output shaft)
37 Drive motor (drive source)
36 Propeller
63 Worm gear
64 Steering motor (rotating electric machine)
66 Worm wheel
67 Worm
68 Worm shaft
68*a* One end portion
68*b* The other end portion
73 Cover
81 Torque receiving portion
84 Opening portion
88 Cap

What is claimed is:

1. An outboard motor that propels a hull by rotating a propeller with a drive source, comprising:

a drive shaft connected to the drive source;

an output shaft that is connected to intersect the drive shaft and with which a propeller is provided;

a worm wheel that is disposed coaxially with the drive shaft and rotates to turn the output shaft around the drive shaft;

a worm that engages with the worm wheel and is connected to a rotating electric machine;

a case that covers the worm and includes an opening portion formed at a portion corresponding to a torque receiving portion; and a cap that is detachably attached to the opening portion and covers the opening portion, wherein the worm includes a torque receiving portion that receives a torque for rotating the worm at the other end portion on a side opposite to one end portion connected to the rotating electric machine.

2. The outboard motor according to claim 1, further comprising:

a case that covers the worm and includes an opening portion formed at a portion corresponding to the torque receiving portion, wherein the torque receiving portion is a member having corrosion resistance.

3. The outboard motor according to claim 1, wherein the torque receiving portion is disposed at a position at which it is rotatable from the hull.

4. The outboard motor according to claim 2, wherein the torque receiving portion is disposed at a position at which it is rotatable from the hull.

5. The outboard motor according to claim 1, further comprising:

a cover that is detachably attached to the case and covers the rotating electric machine provided in the case.

6. The outboard motor according to claim 2, further comprising:

a cover that is detachably attached to the case and covers the rotating electric machine provided in the case.

* * * * *